United States Patent [19]
Ramachandran et al.
[11] Patent Number: 4,472,287
[45] Date of Patent: Sep. 18, 1984

[54] PARTICULATE FABRIC SOFTENING COMPOSITION, FABRIC SOFTENING DETERGENT USEFUL FOR HAND WASHING LAUNDRY AND PROCESS FOR MANUFACTURE AND USE THEREOF

[75] Inventors: Pallassana N. Ramachandran, Robbinsville; Kenneth S. Peterson, Keasbey, both of N.J.

[73] Assignee: Colgate-Palmolive Company, New York, N.Y.

[21] Appl. No.: 449,260

[22] Filed: Dec. 13, 1982

[51] Int. Cl.[3] ..... C11D 3/12; C11D 3/20; D06M 13/24; D06M 13/50

[52] U.S. Cl. ..... 252/8.7; 252/8.6; 252/116; 252/129; 252/131; 252/133; 252/140; 252/155; 252/174.25; 252/539

[58] Field of Search ..... 252/8.6, 8.75, 8.8, 252/116, 129, 130, 131, 133, 140, 155, 89.1, 174.25, 539

[56] References Cited

U.S. PATENT DOCUMENTS

| | | | |
|---|---|---|---|
| 3,852,211 | 12/1974 | Ohren | 252/110 |
| 3,966,629 | 6/1976 | Dumbrell | 252/140 |
| 3,976,588 | 8/1976 | McLaughlin | 252/117 |
| 4,196,104 | 4/1980 | Oguagha | 252/542 |
| 4,203,857 | 5/1980 | Dugan | 252/92 |
| 4,294,710 | 10/1981 | Hardy | 252/8.8 |
| 4,308,151 | 12/1981 | Cambre | 252/8.8 |
| 4,375,416 | 3/1983 | Crisp | 252/8.7 |

FOREIGN PATENT DOCUMENTS

| | | | |
|---|---|---|---|
| 1329416 | 9/1973 | United Kingdom | 252/8.6 |

*Primary Examiner*—Dennis L. Albrecht
*Attorney, Agent, or Firm*—Bernard Lieberman; Herbert S. Sylvester; Murray M. Grill

[57] ABSTRACT

A particulate fabric softening detergent composition comprises certain proportions of synthetic organic detergent, builder salt, bentonite (preferably a swelling Wyoming bentonite) and water insoluble soap (preferably aluminum stearate). The detergent composition preferably comprises spray dried built detergent beads with which are blended agglomerated beads of the bentonite and water insoluble soap. The combination of water insoluble soap and bentonite greatly increases the softening action of the composition when it is employed for hand washing of laundry.

Also disclosed are: particulate compositions intended for addition to a detergent composition to increase fabric softening action thereof, which comprise bentonite and a water insoluble soap; a process for improving the fabric softening properties of a particulate detergent by blending bentonite and water insoluble soap with it; a process for washing and softening laundry by hand washing it in wash water containing a built heavy duty synthetic organic detergent, bentonite and water insoluble soap; and a process for making an agglomerate of bentonite and water insoluble soap.

24 Claims, No Drawings

PARTICULATE FABRIC SOFTENING COMPOSITION, FABRIC SOFTENING DETERGENT USEFUL FOR HAND WASHING LAUNDRY AND PROCESS FOR MANUFACTURE AND USE THEREOF

This invention relates to a particulate fabric softening detergent composition. More particularly, it relates to such a composition comprising certain proportions of synthetic organic detergent, builder salt, bentonite and water insoluble soap. Also within the invention are: compositions containing bentonite and water insoluble soap, which are intended for addition to detergent compositions to increase the fabric softening thereof; a process for improving the fabric softening of a particulate detergent by blending bentonite and water insoluble soap with it; a process for washing and softening laundry by hand washing it in wash water containing a built heavy duty synthetic organic detergent, bentonite and water insoluble soap; and a process for making an agglomerate of bentonite and water insoluble soap.

Particulate built synthetic organic detergent compositions have been made by spray drying a crutcher mix of detergent, builder salt and appropriate adjuvants, and such products have been successfully commercially marketed for many years. Recently fabric softening materials have been incorporated in such detergents so that laundry washed with the detergent would be softened at the same time, thus avoiding previously required additions of softening agents to the rinse water. Cationic softening agents, such as those previously employed in rinse water treatments of laundry to soften it, which have been incorporated in detergent compositions as softeners, can cause discoloration (yellowing) of the laundry after repeated washings. They also react with anionic detergents and they sometimes inactivate fluorescent brighteners, which may be important components of the detergent compositions. Accordingly, in some commercial products the cationic softening agents, usually quaternary ammonium halides, have been replaced by smectite clays which have softening powers, such as the swelling bentonites. It has been found that such softening detergents satisfactorily wash soiled laundry and improve the softness of such laundry. However, it has also been noted that best softening is obtained when the laundry is machine washed and lesser degrees of softening result when the laundry is hand washed.

Insoluble metal stearates, such as aluminum stearate and calcium stearate, have been employed as lubricants and have been incorporated in detergent compositions for their fabric softening properties. However, before the present invention swelling bentonites and insoluble soaps were not employed together in heavy duty built synthetic organic detergent compositions or in conjunction with such compositions in the hand washing of laundry. Consequently the unexpectedly beneficial effect obtained by the use of such combination of materials was previously unknown.

In accordance with the present invention a particulate fabric softening detergent composition comprises from 5 to 35% of synthetic organic detergent selected from the group consisting of anionic and nonionic detergents, 10 to 75% of builder salt for the detergent, 2 to 30% of bentonite and 0.5 to 10 or 20% of a water insoluble soap, such as one from the group consisting of aluminum, calcium, magnesium, barium and zinc soaps of fatty acids of 8 to 20 carbon atoms, and mixtures thereof. Preferably the bentonite will be a swelling sodium bentonite, such as Wyoming bentonite, the water insoluble soap will be a stearate, such as aluminum stearate, the bentonite and insoluble soap will be agglomerated together, the agglomerate will be blended with spray dried beads of the organic detergent and builder salt and the resulting composition will be employed in the hand washing of laundry. Also, within the invention are the described agglomerates, a method for the manufacture thereof, a method for increasing the softening effects of built synthetic detergent compositions and a process for simultaneously washing and softening laundry. The described products and processes lead to greatly improved softening of laundry that is hand washed, which improvement is unexpected.

The detergent composition of this invention, which includes bentonite and insoluble soap, may be any of various types and may be made in various ways. Most preferably, the bentonite and insoluble soap will be agglomerated together to form a particulate composition which may be added to heavy duty built synthetic organic detergent composition particles, to give fabric softening characteristics to such built detergent. Such improvement is especially useful when laundry is to be hand washed with the composition.

The built detergent beads with which such bentonite-insoluble soap agglomerate particles may be blended may be spray dried beads, usually comprising anionic synthetic organic detergent, builder salt, adjuvants and a minor proportion of moisture, and sometimes including nonionic and/or amphoteric detergent instead of or in addition to the anionic detergent. Alternatively, spray dried inorganic builder base beads have nonionic detergent in the liquid state sprayed onto them and absorbed by them. Both such types of built detergent particles may have powdered bentonite and insoluble soap agglomerated onto the surfaces thereof and in some instances the built detergent particles may be blended with powdered bentonite and insoluble soap, without having been agglomerated. Additionally, improved softening of laundry may be obtained by having the consumer add the built detergent to the wash water separately from agglomerated bentonite-insoluble soap particles or from a powdered mixture of such materials or separate powders. However, it is preferred that the bentonite and insoluble soap be agglomerated to particle sizes like those of the detergent composition beads (of detergent, builder, adjuvants and moisture) and be mixed with such beads in a softening proportion.

As was indicated previously, the essential components of built synthetic organic detergent beads or granules include a synthetic organic detergent, which may be an anionic detergent, nonionic detergent, amphoteric detergent or a mixture of two or more of these, a builder or a mixture of builders, and a minor proportion of moisture, although in many instances various adjuvants may also be present. Incidentally, such adjuvants may also be present with the agglomerates and other mixtures of bentonite and insoluble soap. In some cases, in both instances, the builder may be partially replaced by a filler, such as sodium sulfate or sodium chloride, or a mixture thereof, or such filler may be added to the builder and the synthetic organic detergent.

Various anionic detergents, usually as sodium salts but sometimes as potassium, ammonium or alkanolammonium salts, may be employed but those which are most preferred are the sodium linear higher alkylbenzene sulfonates. Although the linear sulfonates are preferred one may also employ the branched ABS detergents, such as the propylene tetramer and propylene pentamer compounds. Other soluble alkyl benzene sulfonates, such as those of 10 or 12 to 18 carbon atoms, can also be employed and will perform satisfactorily as detergents. Preferably the higher alkyl is of 12 to 15 carbon atoms, e.g., 12 or 13, and is a sodium salt. Higher alkyl sulfates and higher fatty alcohol polyethoxylate sulfates may also be used in addition to the alkylbenzene sulfonates or in replacement of some or all thereof. The alkyl sulfate is preferably a higher fatty alkyl sulfate of 10 to 18 carbon atoms, preferably 12 to 16 carbon atoms, e.g., 12, and is also employed as the sodium salt. The higher alkyl ethoxamer sulfates will similarly be of 10 or 12 to 18 carbon atoms, e.g., 12, in the higher alkyl, which will preferably be a fatty alkyl, and the ethoxy content will normally be from 3 to 30 ethoxy groups per mol, preferably 3 or 5 to 20. Again, the sodium salts are preferred. Thus, it will be seen that the alkyls are preferably linear or fatty higher alkyls of 10 to 18 carbon atoms, the cation is preferably sodium, and when a polyethoxy chain is present the sulfate is at the end thereof. Other useful anionic detergents of this sulfonate and sulfate group include the higher olefin sulfonates and paraffin sulfonates, e.g., the sodium salts wherein the olefin or paraffin groups are of 10 to 18 carbon atoms. Specific examples of the preferred detergents are sodium tridecyl benzene sulfonate, sodium tallow alcohol polyethoxy (3 EtO) sulfate, and sodium hydrogenated tallow alcohol sulfate. In addition to the preferred anionic detergents mentioned, others of this well known group may also be present, especially in only minor proportions with respect to those previously described. Also, mixtures thereof may be employed and in some cases such mixtures can be superior to single detergents. The various useful detergents are well known in the art and are described at length at pages 25 to 138 of the text *Surface Active Agents and Detergents,* Vol. II, by Schwartz, Perry and Berch, published in 1958 by Interscience Publishers, Inc.

Small proportions of water soluble soaps, e.g., sodium soaps of fatty acids of 10 to 24 carbon atoms, preferably 14 to 18 carbon atoms, e.g., sodium hydrogenated tallow fatty acids soaps, can be employed, in the crutcher or post-added, as foam controllers, when less foam in the washing machine is desirable.

Although various nonionic detergents of satisfactory physical characteristics may be utilized, including condensation products of ethylene oxide and propylene oxide with each other and with hydroxyl-containing bases, such as nonyl phenol and Oxo-type alcohols, it is highly preferred that the nonionic detergent be a condensation product of ethylene oxide and higher fatty alcohol. In such products the higher fatty alcohol is of 10 to 20 carbon atoms, preferably 12 to 16 carbon atoms, and the nonionic detergent contains from about 3 to 20 or 30 ethylene oxide groups per mol, preferably from 6 to 12. Most preferably, the nonionic detergent will be one in which the higher fatty alcohol is of about 12 to 13 or 15 carbon atoms and which contains from 6 to 7 or 11 mols of ethylene oxide. Such detergents are made by Shell Chemical Company and are available under the trade names Neodol® 23-6.5 and 25-7. Among their specially attractive properties, in addition to good detergency with respect to oily stains on goods to be washed, is a comparatively low melting point, yet appreciably above room temperature, so that they may be sprayed onto base beads as a liquid which solidifies. Among the amphoteric detergents are the various Miranols such as Miranol C2M, Miranol CM, Miranol DM and Miranol DS.

The water soluble builder employed may be one or more of the conventional materials that have been used as builders or suggested for such purpose. These include inorganic and organic builders, and mixtures thereof. Among the inorganic builders those of preference are the various phosphates, preferably polyphosphates, e.g., tripolyphosphates and pyrophosphates, such as pentasodium tripolyphosphate and tetrasodium pyrophosphate. Trisodium nitrilotriacetate (NTA), preferably employed as the monohydrate, and other nitrilotriacetates, such as disodium nitrilotriacetate, are also useful water soluble builders. Sodium tripolyphosphate, sodium pyrophosphate and NTA are preferably present in hydrated forms. Of course, carbonates, such as sodium carbonate, are useful builders and may desirably be employed, alone or in conjunction with bicarbonates, such as sodium bicarbonate. Other water soluble builders that are considered to be effective include the various other inorganic and organic phosphates, borates, e.g., borax, citrates, gluconates, EDTA and iminodiacetates. Preferably the various builders will be in the forms of their alkali metal salts, either the sodium or potassium salt, or a mixture thereof, but sodium salts are normally more preferred. Sodium silicates of $Na_2O$:-$SiO_2$ ratio in the range of 1:1.6 to 1:2.8, preferably 1:2.0 to 1:2.4, e.g., 1:2.35 or 1:2.4, are useful as builder salts and as binders for the detergent composition beads and for agglomerates of bentonite and insoluble soap. Sodium silicate also contributes anti-corrosion properties to the detergent composition, which is of importance when the detergent is to be employed in contact with aluminum or other metals subject to corrosion.

In addition to the water soluble builders mentioned one may also employ water insoluble builders, such as the zeolites. These materials normally will be of the formula $$(Na_2O)_x \cdot (Al_2O_3)_y \cdot (SiO_2)_z \cdot wH_2O$$

wherein x is 1, y is from 0.8 to 1.2, preferably about 1, z is from 1.5 to 3.5, preferably 2 to 3 or about 2, and w is from 0 to 9, preferably 2.5 to 6.

The zeolite should be a univalent cation-exchanging zeolite, i.e., it should be an aluminosilicate of a univalent cation such as sodium, potassium, lithium (when practicable) or other alkali metal or ammonium. Preferably the univalent cation of the zeolite molecular seive is an alkali metal, especially sodium or potassium, and most preferably it is sodium. The most preferable of the zeolites are those designated A, X, Y, with Type 4A being preferred. Preferred zeolites are those which are hydrated to the extent of 5 to 30%, preferably 15 to 25% of moisture content therein, especially when they are of good calcium ion exchange properties, preferably of over 200 milligram equivalents of calcium carbonate per gram.

Various adjuvants may be present in the crutcher mix from which detergent compositions or base beads are sprayed or such adjuvants may be post-added, with the decision as to the mode of addition often being determined by the physical properties of the adjuvant, its resistance to heat, its resistance to degradation in the aqueous crutcher medium, and its volatility. Although some adjuvants, such as fluorescent brightener, pigment, e.g., ultramarine blue, titanium dioxide, and inorganic filler salt may be added in the crutcher, others, such as perfumes, enzymes, bleaches, some colorants, bactericides, fungicides, and flow promoting agents may often be sprayed onto or otherwise mixed with the base beads or spray dried detergent composition with any nonionic detergent to be added, and/or independently, so that they will not be adversely affected by the elevated temperatures of the spray drying operation, and also so that their presence in the spray dried beads does not inhibit absorption of nonionic detergent, when such is to be post-sprayed onto the beads. However, for stable and normally solid adjuvants, mixing with the starting slurry in the crutcher is usually feasible. Thus, it is contemplated that pigments and fluorescent brighteners, when employed, will normally be present in the crutcher mix from which the detergent composition or base beads are sprayed. If any cationic softener, such as a quaternary ammonium compound, e.g., cetyl trimethyl ammonium bromide or distearyl dimethyl ammonium methyl sulfate, is to be present most desirably it will be post-applied or will be in the bentonite-insoluble soap agglomerate.

The bentonite employed is a colloidal clay (aluminum silicate) containing montmorillonite. Montmorillonite is a hydrated aluminum silicate in which about 1/6th of the aluminum atoms may be replaced with magnesium atoms and with which varying amounts of sodium, potassium, calcium, magnesium and other metals, and hydrogen, may be loosely combined. The type of bentonite clay which is most useful in making the invented agglomerated particles is that which is known as sodium bentonite (or Wyoming or western bentonite), which is normally a light to cream-colored impalpable powder which, in water, forms a colloidal suspension having strongly thixotropic properties. In water the swelling capacity of the clay will usually be in the range of 3 to 20 ml./gram, preferably 7 to 15 ml./g., and its viscosity, at a 6% concentration in water, will usually be in the range of 3 to 30 centipoises, preferably 8 to 30 centipoises. Preferred swelling bentonites of this type are sold under the trademark Mineral Colloid, as industrial bentonites, by Benton Clay Company, an affiliate of Georgia Kaolin Co., and as Volclay Special Purpose Powder by American Colloid Company. The Mineral Colloid clays are the same as those formerly sold under the trademark THIXO-JEL, are selectively mined and beneficiated bentonites, and those considered to be most useful are available as Mineral Colloid Nos. 101, etc., corresponding to THIXO-JEL's Nos. 1, 2, 3 and 4. Such materials have pHs (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve. More preferably, the bentonite is one wherein essentially all the particles (over 90%, preferably over 95%) pass through a No. 325 sieve and most preferably over 99% or all the particles pass through such a sieve. Western or Wyoming bentonite is preferred as a component of the present compositions but other swelling bentonites are also useful, especially when they form only a minor proportion of the bentonite used.

Although it is desirable to limit maximum free moisture content, as mentioned, it is even more important to make certain that the bentonite being employed includes enough free moisture, most of which is considered to be present between adjacent plates of the bentonite, to facilitate quick disintegration of the bentonite-insoluble soap or bentonite agglomerate when such particles or detergent compositions containing them are brought into contact with water, such as wash water. It has been found that at least about 2%, preferably at least 3% and more preferably, at least about 4% or more of water should be present in the bentonite initially, before it is agglomerated, and such proportion should also be present after any drying. In other words, overdrying to the point where the bentonite loses its "internal" moisture can significantly diminish the utility of the present compositions. When the bentonite moisture content is too low the bentonite does not satisfactorily aid in disintegrating the agglomerate in the wash water. When the bentonite is of satisfactory moisture content it may have an effective exchangeable calcium oxide percentage in the range of about 1 to 1.8 and with respect to magnesium oxide such percentage will often be in the range of 0.04 to 0.41. Typical chemical analysis of such a material is from 62 to 73% of $SiO_2$, 14 to 22% of $Al_2O_3$, 1.6 to 2.9% of MgO, 0.5 to 3.1% of CaO, 2.3 to 3.5% of $Fe_2O_3$, 0.8 to 2.8% of $Na_2O$ and 0.4 to 7.0% of $K_2O$.

Instead of utilizing the THIXO-JEL or Mineral Colloid bentonites one may also employ equivalent competitive products, such as that sold by American Colloid Company, Industrial Division, as General Purpose Bentonite Powder, 325 mesh, which has a minimum of 95% thereof finer than 325 mesh or 44 microns in diameter (wet particle size) and a minimum of 96% finer than 200 mesh or 74 microns diameter (dry particle size). Such a hydrous aluminum silicate is comprised principally of montmorillonite (90% minimum), with smaller proportions of feldspar, biotite and selenite. A typical analysis, on an "anhydrous" basis, is 63.0% silica, 21.5% alumina, 3.3% of ferric iron (as $Fe_2O_3$), 0.4% of ferrous iron (as FeO), 2.7% of magnesium (as MgO), 2.6% of sodium and potassium (as $Na_2O$), 0.7% of calcium (as CaO), 5.6% of crystal water (as $H_2O$) and 0.7% of trace elements Although the western bentonites are preferred it is also possible to utilize synthetic bentonites, such as those which may be made by treating Italian or similar bentonites containing relatively small proportions of exchangeable monovalent metals (sodium and potassium) with alkaline materials, such as sodium carbonate, to increase the calcium ion exchange capacities of such products. Analysis of a typical Italian bentonite after alkali treatment indicates that it contains 66.2% of $SiO_2$, 17.9% $Al_2O_3$, 2.80% of MgO, 2.43% of $Na_2O$, 1.26% of $Fe_2O_3$, 1.15% of CaO, 0.14 of $TiO_2$ and 0.13% of $K_2O$, on a dry basis. It is considered that the $Na_2O$ content of the bentonite should be at least about 0.5%, preferably at least 1% and more preferably at least 2% (with the equivalent proportion of $K_2O$ also taken into account), so that the clay will be satisfactorily swelling, with good softening and dispersing properties in aqueous suspension, to accomplish the purposes of the present invention. Preferred swelling bentonites of the synthetic types described are sold under the trade names Laviosa and Winkelmann, e.g., Laviosa AGB and Winkelmann G 13. Other clays that may be used, often only in partial replacement of the mentioned bentonites, include those sold under the trade names: Brock; Volclay BC; Gel White GP; Ben-A-Gel; Veegum F; Laponite SP; and Barasym LIH 200.

The binder, which may be employed to assist in holding together the finely divided bentonite particles and insoluble soap powder in agglomerated form, is preferably a sodium silicate such as that previously described as a builder. Instead of silicate one may use other binders, such as the natural and synthetic gums, e.g., xanthan, carrageenan, guar, CMC, PVA, PVP, which also may have desirable adjuvant effects. While binders are useful, in some instances overspraying with water alone may produce a sufficient binding effect.

The water insoluble soaps useful to make the products of this invention are those of 8 to 20 carbon atoms, preferably or 12 to 18 carbon atoms and most preferably of 18 carbon atoms and saturated. Among such soaps are the octoates, decanoates, laurates, myristates, palmitates, oleates (unsaturated) and stearates of aluminum, calcium, magnesium, barium and zinc, and mixtures thereof. Such soaps are usually made by either the fusion method or the precipitation method. In the former of these an appropriate metallic oxide, hydroxide, or salt of a weak acid is reacted directly with the selected fatty acid at an elevated temperature. In the precipitation method a dilute soluble soap solution is first prepared by reacting caustic soda with the selected fatty acid and it is then reacted with a separately prepared salt solution of the desired metal to cause precipitation of the metallic soap. The described soaps, which are normally finely enough divided so that substantially all thereof passes through a No. 200 sieve (U.S. Sieve Series) and in many cases substantially as, e.g., over 95 or 99%, passes through a No. 325 sieve. However, in appropriate circumstances somewhat coarser powders may also be useful, such as those which pass through a No. 100 sieve, but generally the finer the powder the better. Such soaps will normally contain very small proportions, if any, of water soluble salts or moisture and all of them will be powdered solids at room temperature. All of the mentioned soaps are white so they will not adversely affect the appearance of the detergent composition. In fact, they may help to improve the color of the bentonite, which, although nominally white, sometimes tends to appear tannish or creamy. It is noted that the various aluminum soaps may have higher free fatty acid contents than those of calcium, magnesium, barium and zinc, with free fatty acid percentages ranging from 2 to about 30%. However, such does not interfere with functioning of such materials in the present invented compositions and processes. With respect to the aluminum soaps one may employ the di- or tri- salt, e.g., aluminum distearate, aluminum tristearate, but it is considered that a mixture of such soaps is preferable, wherein the proportions will be in the range of 1:3 to 3:1, e.g., about 1:1. Other incompletely reacted insoluble soaps of the other mentioned metals (and aluminum) and of the di- and polyvalent metals, and completely reacted soaps thereof may be employed in various proportions, and mixtures of the various soaps may also be used.

The various mentioned water insoluble soaps are described in a bulletin entitled *Witco Metallic Stearates, Their Properties and Uses,* dated September 1974 and published by Witco Chemical Corporation, New York, N.Y. 10017, which is incorporated herein by reference.

The water employed in making crutcher mixes from which base beads or built detergent beads are spray dried and for making agglomerating sprays is preferably of low hardness and inorganic salt content but ordinary city waters may be used. Usually the hardness content of such waters will be less than 300 p.p.m., as calcium carbonate, preferably less than 150 p.p.m. and most preferably less than 50 or 100 p.p.m.

In the particulate fabric softening detergent composition of this invention the synthetic organic detergent component will be employed in sufficient quantity to exert satisfactory detergency on laundry in the normal wash water concentrations of the composition. Thus, usually from 5 to 35% of the synthetic organic detergent will be employed, preferably 10 to 25%, more preferably 12 to 22%, e.g., 17% (final product basis). While sodium linear tridecylbenzene sulfonate is a preferred anionic detergent, it is understood that other detergents and mixes may be utilized. In those cases where a nonionic detergent is employed, which may be sprayed onto a previously made base beads of inorganic builder salt, more preferred proportions may be from 15 to 22 or 25%, e.g., 20%. The total proportion of builder salt present in the detergent composition will be such as to satisfactorily build the synthetic organic detergent and thereby make it more effective. Normally, such proportion will be in the range of 5 to 75%, preferably 20 to 60% and most preferably about 40 to 50%. When sodium tripolyphosphate is the principal builder salt present the proportion thereof will preferably be from 10 to 50%, more preferably 20 to 30%, e.g., about 24%. When sodium carbonate and sodium silicate are the other principal builders present, proportions thereof will normally be from 2 to 20% of the carbonate, preferably 10 to 15%, and 2 to 12% of the silicate, preferably 6 to 10%, e.g., 12% and 8%, respectively.

The bentonite content of the final detergent composition will normally be in the range of 2 to 30%, preferably being 5 to 30% and more preferably 8 to 25%, e.g., about 18%. The insoluble soap content will normally be 0.5 to 10 or 20%, preferably 0.5 to 15% and more preferably 1 to 5 %, e.g., about 2%. Moisture content is normally 3 to 15%, preferably 7 to 12%, e.g., about 10%. When a filler salt is present (and such filler salt may be replaced by adjuvants and builder), the proportion thereof will usually be from 0 to 40%, preferably 5 to 25%, e.g., about 8%.

When the swelling bentonite and the water insoluble soap are agglomerated together the proportion of bentonite to water insoluble soap may be within the range of about 1:1.5 to 20:1 or 40:1 but generally will be within the range of 1:1 to 15:1 (or thereabout), preferably being in the range of 6:1 to 12:1, e.g., 9:1. The agglomerates, which will normally be of particle sizes in the range of Nos. 10 to 100, U.S. Sieve Series, sometimes being in the range of Nos. 30 to 100, will often comprise from 20 or 40 to 80% of bentonite and 20 to 40 or 50% of water insoluble stearate. While other adjuvants may be present, such as other softening agents, colorants, perfumes, fluorescent brighteners, enzymes and bleaches, to make up the balance of the agglomerate, usually moisture will account for 5 to 15%, thereof, e.g., 8 or 10%, and a binder, such as sodium silicate, will be 0.3 to 5% thereof, preferably 0.5 to 3% thereof, e.g., 0.5 or 1%.

While it has been indicated that the bentonite and water insoluble soap of divalent or polyvalent metal are preferably incorporated in the present detergent compositions as a separate agglomerate, non-integral with the spray dried detergent composition beads or with the spray dried base beads containing detergent, such materials may also be present in other forms than that of such agglomerate (such as powders, agglomerated bentonite with separate insoluble soap powder, and bentonite and insoluble soap agglomerated onto detergent beads). Still, it is highly preferred that the bentonite and insoluble soap be co-agglomerated to produce particles which may be added to spray dried products and will not objectionably segregate from them due to differences in bead densities and particle sizes.

The described agglomerates, which may be manufactured and stored, ready for addition to different types of detergent compositions when softening additives for such may be desirable, are preferably made by the process and with the equipment described in U.S. patent application Ser. No. 366,587 of Barry M. Weinstein, filed Apr. 8, 1982, which is incorporated herein by reference. However, the procedures described in such patent application will be modified so that instead of the agglomeration being of bentonite only, it is of bentonite and insoluble soap powder. In such processes the mixture of bentonite and insoluble soap powder is kept in motion, as by tumbling in an inclined drum equipped with a number of breaker bars, so that the particles are in continuous movement and form a "screen" (which is usually falling), onto which a spray of agglomerating liquid may be directed. The agglomerating liquid employed may be water alone sometimes but preferably the medium will contain a suitable binder, such as have been previously described, together with adjuvants such as colorant, etc., and is directed onto the moving surfaces of the mixed bentonite and insoluble soap, with the spraying and movement of the particles being regulated to produce agglomerates of the desired size range, Nos. 10 to 100 sieve, preferably 30 to 100 and more preferably 40 to 100 or 40 to 80 sieve, U.S. Sieve Series. When the desired size and regularly shaped agglomerated product is produced (with its bulk density desirably often being in the 0.7 to 0.9 g./ml. range) the agglomeration is halted and the beads are dried, if desirable, to suitable moisture, e.g., 10% (which is about the equilibrium moisture content of the bentonite) screened, if desired, and stored for use as an additive to the detergent beads. The solids content of the aqueous spray of binder, if such is present, is suitable, usually being from 2 to 20%, preferably from 4 to 10% and more preferably 6 to 9%, e.g., 7.5% and the moisture content of the agglomerated particles before drying will often be from 20 to 35%, e.g., about 25%. Thus, when such higher moisture contents of the agglomerates result, drying will be desirable but this is not to say that lesser proportions of moisture may not be applied in the agglomerating operation so that drying can be obviated. Often it will be preferable to have the agglomerating spray at an elevated temperature, such as in the range of 50° to 90° C., preferably 60° to 80° C. and desirably the spray will be generated by a spray nozzle designed to produce a fine flat spray pattern which will be directed transversely with respect to the screen of particles created in the agglomerator.

Instead of agglomerating the bentonite and insoluble soap by the method described previously it is also possible to agglomerate either or both (and preferably both) of such materials onto the detergent beads or base beads, for example, by the method of U.S. patent application Ser. No. 411,295 for Process For Manufacturing Bentonite-Containing Particulate Fabric Softening Detergent Composition (Parr, Ramachandran, Grey and Reinish), filed Aug. 25, 1982, which is hereby incorporated by reference. In essence, the same type of spray solution and same type of mixer are employed but the bentonite and insoluble soap are agglomerated onto the surfaces of spray dried beads. In a variation of the described process the bentonite and insoluble soap may be agglomerated onto detergent composition beads at a greater concentration than is desired in the final product and then such agglomerates may be mixed with more detergent composition beads. In such methods of agglomeration, while it is highly desirable to utilize a binding agent, and silicate is preferred because of its effectiveness and its utility as a detergent builder, in some cases it may be possible to omit the binding agent and effect the agglomeration by means of water alone or water and other suitable solvent or liquid medium.

After the agglomerated bentonite and insoluble soap particles have been made they are blended with a particulate detergent composition, such as a built synthetic anionic organic detergent composition which has been spray dried from a crutcher mix, or a built nonionic synthetic organic detergent composition in which the base beads of inorganic builder salt were spray dried and nonionic detergent had been sprayed onto such moving beads (preferably while the beads were tumbling) and had been absorbed by them. The proportion of agglomerate in a total detergent composition will be from 10 to 40% thereof, preferably 15 to 30% and most preferably about 17 to 25% thereof. The particle sizes of the detergent composition and the agglomerate will be appropriately the same, within the Nos. 10 to 100 (U.S. Sieve Series) range, sometimes 30 to 100 or 40 to 80. Although bulk densities of the agglomerate and the detergent beads may be different the agglomerate does not segregate objectionably from the other beads in shipment and during storage. Of course, other components of detergent composition may be post-added, such as hydrated silicate, enzymes, perfume, colorants, bleaches, e.g., sodium perborate, and flow promoting agents (although flow improvers are unnecessary).

In making the bentonite-insoluble soap agglomerate by a process which has previously been referred to, a comparatively dilute aqueous solution of sodium silicate or other binding agent will be sprayed onto the moving surfaces of the mixture of finely divided bentonite and finely divided water insoluble soap for a suitable period to produce a desired agglomerate. Normally throughput time for the agglomerator will average from 3 to 30 minutes, often being from 5 to 15 minutes. Sometimes heat may be applied at the lower end of the inclined agglomerating drum to remove excess moisture from the product during agglomeration and to reduce the moisture content to nearer the range for the final product.

The bentonite and insoluble soap may be pre-mixed before entering the agglomerator or they may each be added to the agglomerator at its upstream (higher) end, with water or binder solution being sprayed onto a moving screen of the mixed materials at about the middle of the drum length. Plural spray nozzles may be employed and sprays applied may be continuous or intermittent. Fines removed from the agglomerator may be returned to it and oversized particles, which can be screened out, may be broken up and then returned for agglomeration. Although it might be expected that the insoluble soap, being of a waxy nature, would not agglomerate satisfactorily with bentonite, satisfactory agglomerated beads are produced by the present process. A final agglomerate of a highly preferred type is one wherein the bentonite is a Wyoming bentonite, the water insoluble stearate is aluminum stearate, the sodium silicate is of $Na_2O:SiO_2$ ratio of about 1:2.4 and the agglomerate includes about 70 to 90% of bentonite, 4 to 15% of insoluble soap (preferably the stearate), 0.5 to 3% of sodium silicate, preferably 75 to 85%, 6 to 10%, 0.8 to 1.5% and 8 to 12% of moisture, respectively for such components. More preferably the agglomerated particles comprise about 81% of bentonite, about 8% of aluminum stearate (mixed di- and tristearate), about 0.5 or 1% of sodium silicate and about 8 or 10% of moisture, and are of particle sizes within the Nos. 10 to 100 sieve range (U.S. Sieve Series), e.g., 30 to 100.

In the machine washing and softening of laundry the concentration of the built heavy duty synthetic organic detergent composition employed in the wash water will usually be in the range of 0.05 to 0.5% of built synthetic organic detergent composition. Preferably such concentration will be from 0.07 to 0.2%, more preferably about 0.15% for top loading washing machines, according to American practice, and for side loading machines approximately half such percentage will often be used. In European practice, wherein higher temperature wash water is usually employed and detergent composition concentrations are generally greater, such concentrations may be from 0.2 to 0.6%, e.g., 0.4%. However, for hand washing-softening of laundry, wherein washing vessels smaller than washing machine tubs or drums may be used, the concentration of detergent composition may be from about 0.2 to 1%, preferably 0.3 to 0.7%. The figures given are exclusive of the bentonite agglomerate. The concentration of bentonite present in the various wash waters will be about 0.005 to 0.3%, preferably 0.03 to 0.2%, and most preferably 0.06 to 0.14% (the last range being for hand washing). The concentration of insoluble soap will be from 0.001 to 0.2%, preferably 0.003 to 0.02%, and most preferably (for hand washing) 0.006 to 0.014%. The concentrations of the present compositions in the wash water will usually be 0.06 to 1.4%, preferably 0.1 to 1%, and most preferably (for hand washing) 0.4 to 0.9%. Of course, whil=it is preferred that the bentonite and the insoluble soap be co-agglomerated, the concentrations given apply to different products and components so long as the bentonite and insoluble soap are added to the wash water and such wash water is employed for hand washing of laundry.

It has been noted that in hard water some insoluble soaps may be formed due to reaction of water soluble soaps (when present) with hardness cations but although such "in situ" insoluble soaps may be of assistance in improving the softening effect of bentonite in the present media, especially in hand washing of laundry, they are not as satisfactory as the insoluble soaps added to the detergent. Also, detergent compositions must be useful in waters of all types of hardnesses and one cannot depend on sufficient hardness always being present in the wash water employed to produce the desired proportion and type of insoluble soap to soften the laundry satisfactorily. If soluble salts of hardness cations, such as calcium chloride or aluminum chloride are added to the wash water with a water soluble soap, such as sodium hydrogenated tallow soap, preferably in stoichiometric proportions, insoluble soap can be produced in situ and will be more effective than that produced by normal hard water. Such represents another facet of the present invention but it is not considered to be as useful as the other aspects of the invention already described.

Although the products of this invention are free flowing, attractive, non-segregating, effective detergents, which soften the fabrics of laundry washed with them, thereby obviating the need to add a separate softening material in the rinse water, and although the products are eminently satisfactory as detergents and fabric softeners, the primary improvement resulting from the present invention is in softening capability in the hand-washing of laundry. While automatic washing machines are widely employed and tests of laundry detergent properties are usually run in them, many consumers throughout the world, including some in the "developed" and industrial countries, wash laundry by hand. It has been noted that such hand washing of laundry does not result in good softening when bentonite is incorporated in detergent compositions, whether the bentonite is spray dried with the composition or agglomerated and post-added. Various theories have been advanced as to why this lesser softening activity of bentonite in detergent compositions employed for hand washing laundry occurs. According to one such theory,in the normal washing machine the wash water is drawn through the laundry when the tub is drained, thereby bringing the bentonite into intimate contact with the laundry, which serves as a strainer, holding the bentonite particles. In hand washing, on the contrary, this "straining" effect may not be present and therefore not as much bentonite will be held to the laundry. According to this theory the insoluble soap, by some mechanism which is not clear, helps to attract the bentonite to the fibers of the laundry fabrics. Although the theory given appears to be valid it is to be understood that applicants are not bound by it and it should not have any limiting effect on the present invention. Whatever the explanation, it has been proven that the combination of insoluble soap and bentonite gives greatly improved softening when detergent compositions containing such combination are utilized. Such products are also satisfactory for machine washing but in such applications there is relatively little difference in softening effect between the bentonite alone and the bentonite in combination with the insoluble soap. A modified product of this invention, in the form of a bar or cake, of the compositions previously described, sometimes with from 10 to 70% of the synthetic organic detergent content thereof replaced by sodium higher fatty acid soap, preferably a mixture of coconut oil and hydrogenated tallow soap, will be especially convenient for hand washing of laundry and in some instances such bar or cake may be combined with a sponge or foamed plastic surface, as in U.S. Pat. No. 4,203,857 (Dugan) for best application characteristics. Suitable plasticizing and/or binding agents, such as soaps, higher fatty acids, and/or natural and synthetic organic gums may be present, and the bars or cakes may be made by extrusion, stamping and/or compacting.

The following examples illustrate but do not limit the invention. Unless otherwise mentioned, in such examples and throughout the specification all temperatures are in ° C. and all parts and percentages are by weight.

EXAMPLE 1

| Components | Percentage (by weight) |
|---|---|
| Sodium tridecylbenzene sulfonate (linear alkyl) | 21.3 |
| Pentasodium tripolyphosphate | 30.0 |
| Sodium carbonate (anhydrous) | 6.3 |
| Sodium silicate ($Na_2O:SiO_2$ = 1:2.4) | 8.8 |
| Optical brightener (Tinopal 5BM Conc.) | 0.4 |
| Perfume | 0.4 |
| Sodium sulfate (anhydrous) | 22.8 |
| Water (city water of 100 p.p.m. $CaCO_3$ hardness content) | 10.0 |

-continued

| Components | Percentage (by weight) |
|---|---|
| | 100.0 |

Detergent beads of the above formulation, of particle sizes in the Nos. 10 to 100 sieve range (U.S. Sieve Series) are made by spray drying a 50% aqueous crutcher mix of the various components except for the perfume, employing a normal countercurrent spray tower and conventional drying conditions. The perfume is post-added to the dried detergent composition beads, after they are cooled to about room temperature, by spraying it onto the surfaces of the beads while they are being mixed.

Powdered Wyoming bentonite (Thixo-Jel No. 1) and aluminum stearate, both of which components are initially in finely divided form, such that over 95% thereof will pass through a No. 325 screen (U.S. Sieve Series), are agglomerated in an inclined tumbling drum, like that described in U.S. patent application Ser. No. 366,587, previously mentioned herein, for about 12 minutes with the aid of an aqueous spray of sodium silicate of $Na_2O$:-$SiO_2$ ratio of about 1:2.4. Equal weights of the swelling sodium bentonite and the aluminum stearate (which is a mixture of about equal parts of the distearate and tristearate) are first mixed together in the tumbling drum, which is equipped with breaker bars, after which the aqueous solution of sodium silicate (about 7.5% solids content) is sprayed onto the surfaces of the moving particles, which have formed a falling screen, and mixing is continued until the desired particle sizes (about Nos. 10 or 30 to 100 screens) are obtained, which takes about 12 minutes. During that time the silicate content of the agglomerate is increased to about 1% and the moisture content is raised to about 20 to 25%. The particles are then dried to a moisture content of about 10% and are screened to the desired Nos. 30 to 100 screen range.

In a conventional mixer for detergent products, such as a Day mixer, in which the mixing blades move at relatively slow speeds, so as not to size reduce the detergent and softening agglomerate beads, there are mixed together ten parts of the detergent composition beads and 2.8 parts of the agglomerated beads of swelling bentonite and aluminum stearates mixture. Thus, such mixture contains ten parts of detergent composition, 1.25 parts of swelling bentonite and 1.25 parts of aluminum stearate, plus water and silicate in the agglomerate beads.

The softening detergent composition, containing the bentonite and aluminum stearate, is added to wash water which is at 25° C. and is of 100 parts per million hardness as calcium carbonate (actually mixed calcium and magnesium hardness in about 2:1 ratio) to a concentration of 3.6 grams per liter, and the laundry, including items of cotton, polyester, and cotton/polyester blends is hand washed, rinsed and dried on a clothes line in the open air. After drying, a panel of skilled observers evaluates the softness of the laundry and finds it highly acceptable. In similar tests, utilizing half the concentration of softening detergent composition, a lesser but still useful and desirable degree of softening is noted. The softening detergent is free flowing and of attractive appearance and satisfactorily removes both clay and oily (sebum) soil from ordinary and test laundry washed with it. As a control, a softening detergent composition containing four parts of the detergent composition described herein (without the bentonite-insoluble soap agglomerate) and one part of bentonite agglomerate is employed at the same concentration and the same procedure is followed. The test panel finds that the laundry washed with such compositions, while softer than laundry washed with only the detergent composition portion, is not as soft as comparable laundry washed with the product of this invention that contains about 10% of each of the bentonite and the aluminum stearate. Also, when for the 20% of bentonite in the described control product there is substituted 20% of aluminum stearate and the same treatment and evaluation procedures are followed, the softening effect on the laundry which is observed is less than that obtained with the mentioned product of this invention.

When, instead of aluminum stearate, other aluminum soaps, such as aluminum palmitate, aluminum myristate and aluminum laurate are employed, all of which are about equal mixtures of the di- and tri-alkanolates, similar results are obtained. Such is also the case with the corresponding oleate and with mixtures of the soaps, such as mixtures of the stearate and oleate, mixtures of the laurate and myristate, and mixtures of laurate, myristate, palmitate, oleate and stearate. Furthermore, when instead of aluminum soaps, those of calcium, magnesium, barium and zinc are substituted in all of the experiments previously described similar results are obtained, although none of the other soaps is as effective as those of aluminum.

Results similar to those described above are obtained when the mixtures of detergent composition and fabric softening agglomerates are compacted to bar, cake or briquette form, or are incorporated into sponge-faced detergent cakes, and when the bars are employed to rub against the more soiled areas of the laundry, such as collars and cuffs, better cleaning and softening of such previously soiled areas are noted. In such bars various plasticizing components may also be present, such as 10% of the final product of sodium soap, e.g., sodium stearate, or of a plasticizer such as a higher fatty alcohol, e.g., cetyl alcohol, or a higher fatty acid, e.g., stearic acid, or mixed coco and hydrogenated tallow fatty acids. In some such instances a water soluble salt capable of forming an insoluble soap with the soluble stearate or fatty acid source may be present in the composition in such proportion as to produce the desired concentration of insoluble soap in the wash water. Alternatively, only some of the insoluble soap in the fabric softening detergent composition can be replaced by one or more of water soluble aluminum, calcium, magnesium, barium and zinc salts, e.g., aluminum sulfate, calcium chloride, magnesium sulfate, barium chloride or zinc chloride, and only part, e.g., 10%, 50%, of the insoluble soap, will be replaced by soluble soap. Such a partial replacement of the insoluble soap by stoichiometric proportions of materials capable of producing such soap in situ may also be utilized for the particulate detergents, as well as for the cake form products. The articles and compositions which incorporate such materials which react to produce insoluble soaps in situ give improved softening when employed for hand washing of laundry in the manner previously described.

Although it is more convenient to utilize the fabric softening detergent compositions of this invention one also takes advantage of the invention by separately adding the swelling bentonite and insoluble soap to the wash water containing the detergent composition. Such addition is made prior to or after the detergent is added, although generally it is preferred that it be afterward. Thus, agglomerated bentonite-insoluble soap product is added to the wash water or the components thereof are added separately. Powdered insoluble soaps may be present with bentonite agglomerate in the softening detergent or powdered bentonite may be used with an insoluble soap agglomerate in such detergent. The detergent composition may initially contain either the bentonite or the insoluble soap and the other may be admixed with such composition in the wash water. Also, the water insoluble soap may be made in situ in the wash water by additions of water soluble soap, fatty acid or other source of fatty acid, and insolubilizing metal salt. When the fatty acid soap or suitable source is employed it will preferably be in emulsion and/or solution form and the insolubilizing metal salt will preferably be in aqueous solution. In all such cases the wash water made, with the softening combination therein, is effective to both wash and soften laundry significantly better than wash waters containing the detergent composition and in which the concentration of one or the other of the bentonite and insoluble soap material is equal to the experimental concentration of both such materials present when the process of the invention is followed.

EXAMPLE 2

So that washing conditions may be accurately reproduced for the obtaining of comparative data on softening effects of the invented fabric softening detergent compositions and the washing-softening processes, a laboratory procedure is carefully followed and gives comparative results for hand washing operations. In such procedure a four liter beaker containing one liter of water (100 p.p.m. hardness, as $CaCO_3$) at 25° C. has the formula proportions of detergent composition, swelling bentonite (Mineral Colloid No. 101) and water insoluble soap added to it. A terrycloth towel (face cloth size) is placed in the water and it and the water containing the detergent composition are stirred for 30 seconds, after which the towel is allowed to soak for ten minutes, and is then hand washed for an additional 30 seconds. The towel is next rinsed in one liter of water and is line dried.

When the detergent composition is that described in Example 1 and the concentration thereof is 2.8 g./l. (no bentonite and no insoluble soap present) a panel of evaluators, using a scale from 1 to 10 to describe increasing degrees of softness, evaluates the hand washed and line dried terrycloth towel as having a softness rating of only 1. When the same operation is repeated but with 0.7 g./l. of Mineral Colloid 101, agglomerated or powdered, also present in the wash water, the softness rating increases to 5. However, when the same test is run but 0.35 g./l. of the swelling bentonite and 0.35 g./l. of metal stearate are present either as an agglomerate or as separately added powders, with the same concentration of detergent composition, the softness ratings increase to 8, 6 and 6, respectively, for aluminum stearate, calcium stearate and barium stearate. Similar results are obtainable with magnesium stearate and zinc stearate and with corresponding laurates, myristates, palmitates, oleates, mixtures thereof and mixtures of such insoluble soaps of mixed coco and hydrogenated tallow fatty acids. Similar results are also obtainable when the concentrations of the bentonite-insoluble soap mixtures are cut in half and to one-third, with the softening ratings being lower but still being better than those for the bentonite alone at the doubled "softening agent" concentration. When the concentration of bentonite-insoluble soap agglomerate is increased by a half or doubled, further improvements in softening result. Such improvements also result when the bentonite concentration is varied to 0.35 or 0.7 g./l. and insoluble soap content is cut to 0.07 to 0.18 g./l.

When similar tests are run wherein 2.8 g./l. of the detergent composition is present in the wash water with 0.7 g./l. of each of the listed insoluble stearates, but with no bentonite present, softness ratings of 4, 1 and 3, respectively, are obtained for the formulas containing aluminum stearate, calcium stearate and barium stearate. Similar lower softening is obtained when magnesium stearate and zinc stearate are employed and when others of the mentioned insoluble soaps and mixtures thereof are used at double such concentrations. Generally the same comparative results are also obtained when the total concentrations of detergent and softening additive in the wash water are cut to one-half and one-third or correspondingly increased.

The above results establish that unexpectedly beneficial improvements in fabric softening are obtained when swelling bentonite and water insoluble soap of the types described are incorporated in a fabric softening detergent composition, preferably as an agglomerate therewith.

EXAMPLE 3

The procedure of Example 2 is followed except for employing only aluminum and calcium stearates, using them at lower concentrations and evaluating cloths washed with detergent compositions containing bentonite and such insoluble soaps directly against cloths washed with detergent compositions containing twice the bentonite concentration and no insoluble soap. Thus, in Experiment A of this Example the concentration of the detergent base material is 2.8 g./l. and that of bentonite agglomerate is 0.7 g./l. In Experiment B the same concentration of detergent portion is employed, the bentonite concentration is cut to 0.35 g./l. and 0.18 g./l. of aluminum stearate is also present. In Experiment C the concentration of the detergent portion remains at 2.8 g./l. and those of the bentonite and stearate are the same as in Experiment B but the stearate is calcium stearate.

A panel of seven evaluators compared for softness Product A against towels of the same type washed with Products B and C. All seven evaluators preferred Products B and C to Product A for softness. Similar results are obtained when a mixture of 0.09 g./l. of aluminum stearate and 0.09 g./l. of calcium stearate are employed in place of the 0.18 g./l. of insoluble soap. Similar results are also obtainable when magnesium stearate, barium stearate and zinc stearate are each substituted for the insoluble soap(s) in the above experiments.

Similar comparative results are obtained when Experiments A, B and C are repeated but with 0.07 g./l. of aluminum stearate in one case and that proportion of calcium stearate in the other being substituted for the 0.18 g./l. concentrations previously employed.

Results like those reported in this example are obtained whether the bentonite and insoluble soap are coagglomerated, or in powder form, or if one is agglomerated and the other is present as a powder. Also, such results are obtainable when the insoluble soap is spray dried with the balance of the detergent composition, except for the bentonite, which is preferably agglomerated. In some cases the bentonite may also be in the spray dried composition but care must be taken to prevent excessive dehydration thereof. However, agglomerates of the bentonite and insoluble soap are highly preferred because the insoluble soap is kept in intimate contact with the bentonite, the fabric softening action of which it effects, and the agglomerates are readily employable with and are easily incorporated into various types of detergent compositions to impart fabric softening properties to them. For example, when the nonionic-based particulate detergent of Example 5 of U.S. patent application Ser. No. 368,736 has bentonite-insoluble soap agglomerates of aluminum stearate and/or calcium stearate, respectively (of 81 parts bentonite, 8 parts insoluble soap, 1 part silicate and 10 parts water), incorporated into it so that the agglomerate is about 23% of the final composition, improved softening is obtained, compared to such products containing only bentonite, despite doublings of bentonite contents in the "controls" and the use of correspondingly more of the compositions. The detergent composition portion of Example 5 of Ser. No. 368,736 comprises 22 parts of sodium carbonate, 16 parts of sodium bicarbonate, 32 parts of Zeolite A (hydrated to 20% moisture content), 1.5 parts of fluorescent brightener, 0.5 part of perfume, 9 parts of moisture and 19 parts of nonionic detergent (Neodol 23-6.5). As described in Ser. No. 368,736, such detergent composition portion is made by spray drying the 60% solids crutcher mix of all the constituents except the perfume and nonionic detergent, and post-spraying onto the moving bead surfaces the nonionic detergent, followed by the perfume (although in some instances it will be desirable to spray the perfume onto the final product beads after the detergent composition is mixed with the bentonite-insoluble soap agglomerate).

EXAMPLE 4

| Components | Composition Designation D | E | F | G |
|---|---|---|---|---|
| | Percentage (by weight) | | | |
| Sodium linear tridecylbenzene sulfonate | 17 | 17 | 17 | 17 |
| Pentasodium tripolyphosphate | 24 | 24 | 24 | 24 |
| Sodium carbonate (anhydrous) | 15 | 15 | 15 | 15 |
| Swelling bentonite (American Colloid Company Special Purpose Powder AEG-325) | 0 | 20 | 20 | 20 |
| Aluminum stearate (Witco Chemical Corporation #18) | 0 | 0 | 2 | 5 |
| Sodium silicate ($Na_2O:SiO_2$ = 1:2.4) | 7 | 7 | 7 | 7 |
| Optical brightener | 0.3 | 0.3 | 0.3 | 0.3 |
| Perfume | 0.2 | 0.2 | 0.2 | 0.2 |
| Sodium sulfate (anhydrous) | 26.5 | 6.5 | 4.5 | 1.5 |
| Moisture | 10 | 10 | 10 | 10 |
| | 100.0 | 100.0 | 100.0 | 100.0 |

The above compositions are made according to the method described in Example 1, with the bentonite-insoluble soap agglomerates being manufactured in the same way, and the compositions are tested substantially in accordance with the method described in Example 2. Additionally, the various detergent compositions are tested for foam height on washing and are found to be substantially equal, indicating that the contents of bentonite and insoluble soap did not adversely affect foaming power. Compositions D, E and F were evaluated for softness by hand washing substantially in accordance with the method of Example 2. Thus, such products were added to tap water at room temperature to produce three different wash solutions, of concentrations, of 1.5, 3.5 and 7.0 g./l. Two cotton hand towels were hand-washed in each of the wash solutions in a wash bucket and were rinsed in tap water, hand-squeezed and line dried. After drying, the towels were evaluated for softness by nine panelists. In each case, (all three concentrations) seven of the nine panelists preferred the towels washed in a washing medium of Composition F over those washed in the media of Compositions D and E. Also, at all three concentrations the towels washed in the "solution" of Composition E were found to be softer than those washed in that of Composition D.

The results of these comparisons of softening effects on towels of the three different detergent-softener compositions show that while the bentonite content alone imparts softening to cotton, the addition of the insoluble soap significantly improves the softness under hand washing conditions. In similar tests, utilizing washing machines, the softening difference between Compositions F and E are not as great. All the products appeared to be good detergents.

To confirm the results of the panel tests an expert evaluator evaluated for softness towels washed at a concentration of 3.5 g./l. with Compositions D, E, F and G. Such evaluation was made using a scale of 1 to 10, indicating increasing degrees of softness, 10 being softer than 1. The towels washed by Composition D were rated 1 for softness whereas those washed by Composition E were rated 4. The towels washed by Compositions F and G were rated 8, which is near to perfect softness (10) and makes the detergent compositions successfully marketable as softening detergents. In similar tests, omitting the bentonite and replacing it with sodium sulfate, when 2% of aluminum stearate is in the formula and 3.5 g./l. is the concentration employed, the softness rating is about 3 and even employment of much higher percentages of aluminum stearate, from 10 to 50% thereof, does not result in a softening effect evaluation greater than about 4.

Results similar to those reported herein are obtainable when in the formulas of Compositions D, E, F and G other anionic detergents, such as lauryl alcohol sulfate, branched higher alkylbenzene sulfonates, such as sodium dodecylbenzene sulfonate and sodium tridecylbenzene sulfonate, sodium lauryl polyethoxy sulfate of 7 ethoxy groups per mol, sodium higher paraffin sulfonate and sodium olefin sulfonate, of about 14 carbon atoms each, are employed in place of the LAS anionic detergent, tetrasodium pyrophosphate (TSPP) is employed in place of the STPP, sodium carbonate is replaced by sodium bicarbonate or sodium sesquicarbonate, aluminum stearate is replaced by calcium stearate, zinc myristate, barium palmitate or magnesium oleate or mixtures thereof, sodium silicate is replaced by post-added hydrated sodium silicate or is omitted, and sodium sulfate is replaced by sodium chloride. Also, similar results are obtainable when the various described adjuvants are employed in limited quantity, usually up to 20%, preferably up to 10% and more preferably 1% or less.

Likewise, when nonionic detergent-based or amphoteric detergent-based products are made, as by replacement of the LAS with a condensation product of a higher fatty alcohol, such as a mixture of lauric and myristic alcohols with ethylene oxide, such as 6 to 7 mols of ethylene oxide, the nonionic detergent being sprayed onto spray dried base beads of the inorganic builder salts and heat resistant additives, or when the LAS is replaced by at least some amphoteric detergent, such as one of the mentioned Miranols, similar improvements in softening effects are obtainable.

It will be noted that in the products of Example 4 the contents of bentonite are greater than in the products of Examples 1–3 and the contents of insoluble soap, in those compositions containing such material, are also relatively lower. Yet, when 20% of bentonite is employed without insoluble soap the softening effect resulting after hand washing is much less (see the evaluations of the product of Experiment E). Yet, when 20% of bentonite is used in the same formulas without insoluble soap and the towels are machine washed with such product satisfactory softness is obtained. The employment of 20% bentonite in the formulas of this invention allows them to be used for both hand washing and machine washing without running the risk of having insufficient bentonite present to satisfactorily soften laundry.

In addition to employing the bentonite-insoluble soap agglomerates in the detergent composition and in the wash water, alternatively such agglomerate may be added to the rinse water, whether or not also present in the detergent composition employed. In using it in the rinse water approximately the same total quantity of softener agglomerate or the softening components thereof should be present as would be used in the wash water with the detergent composition. The products of such rinse water treatment are essentially as soft as those treated in the washing operation by the "softergent" washing composition of this invention, and in some cases may be softer.

The invention has been described with respect to various illustrations and working examples thereof but is not to be limited to these because it is evident that one of skill in the art, with the present specification before him, will be able to utilize substitutes and equivalents without departing from the invention.

What is claimed is:

1. A particulate composition for addition to a detergent composition to increase fabric softening action thereof, which detergent composition is suitable for use in hand washing laundry, which comprises a swelling bentonite and a water insoluble soap selected from the group consisting of aluminum, calcium, magnesium, barium and zinc soaps of fatty acids of 8 to 20 carbon atoms, and mixtures thereof, with the proportion of bentonite to water insoluble soap being in the range of about 1:1.5 to 40:1.

2. A particulate composition according to claim 1 wherein the swelling bentonite is a sodium bentonite and the proportion of bentonite to water insoluble soap is in the range of about 1:1.5 to 20:1.

3. A composition according to claim 2 which is an agglomerate of the bentonite and the water insoluble soap, of particle sizes in the range of Nos. 10 to 100, U.S. Sieve Series.

4. A composition according to claim 3 wherein the water insoluble soap is a stearate, and which composition comprises from 0.3 to 5% of sodium silicate, which helps to bind together the bentonite and the stearate.

5. A composition according to claim 4 wherein the bentonite is a Wyoming bentonite and the insoluble soap is aluminum stearate, and the proportion thereof is in the range of about 1:1 to 15:1.

6. A composition according to claim 4 comprising about 70 to 90% of bentonite, 4 to 15% of water insoluble stearate, 0.5 to 3% of sodium silicate of $Na_2O:SiO_2$ ratio in the range of 1:1.6 to 1:2.8, and 5 to 15% of moisture.

7. A composition according to claim 5 comprising about 70 to 90% of bentonite, 4 to 15% of aluminum stearate, 0.5 to 3% of sodium silicate of $Na_2O:SiO_2$ ratio in the range of 1:1.6 to 1:2.8, and 5 to 15% of moisture.

8. A process for improving fabric softening properties of a particulate detergent composition to produce a composition suitable for hand washing laundry, which comprises mixing with such detergent composition a total amount from 10 to 40% thereof of swelling bentonite and water insoluble soap selected from the group consisting of aluminum, calcium, magnesium, barium and zinc soaps of fatty acids of 8 to 20 carbon atoms, and mixtures thereof, with the bentonite:soap proportion being in the range of 1:1.5 to 40:1.

9. A process according to claim 8 wherein the bentonite is a swelling bentonite, the water insoluble soap is a stearate selected from the group consisting of aluminum, calcium, magnesium, barium and zinc stearates and mixtures thereof, the proportion of bentonite to water insoluble stearate is in the range of 1:1 to 15:1, the bentonite and water insoluble stearate are agglomerated to particle sizes in the range of Nos. 10 to 100, U.S. Sieve Series, and the particulate detergent is of particles in such size range.

10. A particulate fabric softening detergent composition, suitable for hand washing laundry, comprising from 5 to 35% of synthetic organic detergent selected from the group consisting of anionic and nonionic detergents, 5 to 75% of builder salt for the detergent, 2 to 30% of bentonite and 0.5 to 20% of a water insoluble soap selected from the group consisting of aluminum, calcium, magnesium, barium and zinc soaps of fatty acids of 8 to 20 carbon atoms, and mixtures thereof.

11. A detergent composition according to claim 10 wherein at least a portion of the composition is spray dried and the bentonite is a swelling bentonite, in particles separate from the spray dried portion of the composition.

12. A detergent composition according to claim 11 wherein the bentonite is agglomerated into particles of sizes like those of the spray dried portion of the composition.

13. A detergent composition according to claim 12 wherein the bentonite and the water insoluble soap are present in the agglomerated bentonite particles.

14. A detergent composition according to claim 13 comprising from 10 to 25% of synthetic anionic organic detergent, 10 to 50% of a phosphate builder for such detergent, 5 to 30% of swelling bentonite, 0.5 to 15% of the insoluble soap, 0 to 40% of filler salt and 3 to 15% of water.

15. A detergent composition according to claim 14 wherein the anionic detergent is higher alkylbenzene sulfonate in which the higher alkyl thereof is of 12 to 18 carbon atoms, the phosphate is sodium tripolyphosphate, the bentonite is a sodium bentonite, the insoluble soap is a stearate, and the filler salt is sodium sulfate.

16. A detergent composition according to claim 15 wherein the alkylbenzene sulfonate is selected from the group consisting of sodium linear dodecylbenzene sulfonate, sodium linear tridecylbenzene sulfonate and mixtures thereof and is 12 to 22%, the sodium tripolyphosphate is 20 to 30%, the bentonite is 8 to 25%, the insoluble soap is 1 to 5%, the sodium sulfate is 5 to 25%, and the water is 7 to 12% of the composition, and which composition comprises from 3 to 20% of sodium carbonate and from 2 to 12% of sodium silicate.

17. A bar or cake of fabric softening detergent composition suitable for hand washing laundry comprising a particulate fabric softening detergent composition comprising from 5 to 35% of synthetic organic detergent selected from the group consisting of anionic and nonionic detergents, 5 to 75% of builder salt for the detergent, 2 to 30% of bentonite and 0.5 to 20% of a water insoluble soap selected from the group consisting of aluminum, calcium, magnesium, barium and zinc soaps of fatty acids of 8 to 20 carbon atoms, and mixtures thereof.

18. A process for making a composition which is useful for increasing fabric softening action of detergent compositions to make compositions suitable for hand washing laundry which comprises spraying an aqueous solution of a binder onto moving surfaces of a mixture of finely divided bentonite and finely divided water insoluble soap selected from the group consisting of aluminum, calcium, magnesium, barium and zinc soaps of fatty acids of 8 to 20 carbon atoms, and mixtures thereof, to produce agglomerates thereof of particle sizes in the Nos. 10 to 100 range, U.S. Sieve Series.

19. A process according to claim 18 wherein the bentonite is a swelling bentonite, the water insoluble soap is a stearate, the binder is sodium silicate of $Na_2O$:-$SiO_2$ ratio in the range of 1:1.6 to 1:2.8 and the agglomerate comprises about 70 to 90% of bentonite, 4 to 15% of water insoluble soap, 0.5 to 3% of sodium silicate and 5 to 15% of moisture.

20. A process according to claim 19 wherein the bentonite is a Wyoming bentonite, the water insoluble stearate is aluminum stearate, the sodium silicate is of $Na_2O$:$SiO_2$ ratio of about 1:2.4 and the agglomerated particles comprise about 81% of bentonite, about 8% of aluminum stearate, about 1% of sodium silicate and about 10% of moisture.

21. A process for washing and softening laundry which comprises washing such laundry in wash water containing a built heavy duty synthetic organic detergent composition, suitable for hand washing laundry, at a concentration in the range of 0.05 to 1.0%, exclusive of any bentonite and insoluble soap present in it, about 0.005 to 0.3% of bentonite and 0.001 to 0.2% of a water insoluble soap selected from the group consisting of aluminum, calcium, magnesium, barium and zinc soaps of fatty acids of 8 to 20 carbon atoms, and mixtures thereof.

22. A process according to claim 21 wherein the built heavy duty synthetic organic detergent comprises a synthetic anionic organic detergent and a phosphate builder salt, the concentration thereof in the wash water is in the range of 0.3 to 0.7%, the bentonite is a sodium bentonite, the water insoluble soap is aluminum stearate, the proportions of bentonite and aluminum stearate are within the ranges of 0.03 to 0.2% and 0.003 to 0.02%, respectively, and the washing of the laundry is hand washing thereof.

23. A process for washing and softening laundry which comprises washing such laundry in wash water containing a built heavy duty synthetic organic detergent at a concentration in the range of 0.05 to 1.0%, exclusive of any bentonite present in it and exclusive of any heavy metal salt and soluble soap in stoichiometric proportions for producing a water insoluble soap on reaction thereof, about 0.005 to 0.3% of bentonite, and water soluble soap and metal salt reacted therewith in sufficient quantity to produce about 0.001 to 0.2% of water insoluble soap, wherein the metal of such soap is selected from the group consisting of aluminum, calcium, magnesium, barium, zinc and mixtures thereof and the soluble soap is a soap of a fatty acid or fatty acid mixture of 8 to 20 carbon atoms.

24. A process according to claim 23 wherein the washing of the laundry is hand washing.

* * * * *